US007231943B2

(12) United States Patent
Svensson

(10) Patent No.: US 7,231,943 B2
(45) Date of Patent: Jun. 19, 2007

(54) DEVICE FOR A WEAVING MACHINE

(75) Inventor: Stefan Svensson, Almhult (SE)

(73) Assignee: Texo AB, Almhult (SE)

( * ) Notice: Subject to any disclaimer, the term of this patent is extended or adjusted under 35 U.S.C. 154(b) by 400 days.

(21) Appl. No.: 10/746,260

(22) Filed: Dec. 29, 2003

(65) Prior Publication Data

US 2004/0261881 A1 Dec. 30, 2004

(30) Foreign Application Priority Data

Mar. 25, 2003 (SE) ..... 0300809

(51) Int. Cl.

| | |
|---|---|
| ***D03D 51/08*** | (2006.01) |
| ***D03D 51/34*** | (2006.01) |
| ***D03D 47/25*** | (2006.01) |
| ***D03D 47/18*** | (2006.01) |
| *D03D 51/02* | (2006.01) |
| *D03D 49/50* | (2006.01) |

(52) U.S. Cl. ..... 139/116.1; 139/1 E; 139/438; 139/444; 139/445; 139/446; 139/449

(58) Field of Classification Search ..... 139/1 E, 139/116.1, 438, 444–446, 449
See application file for complete search history.

(56) References Cited

U.S. PATENT DOCUMENTS 3,386,477 A * 6/1968 Durand ..... 139/449
3,865,147 A * 2/1975 Lev et al. ..... 139/1 E
4,458,726 A * 7/1984 Wenig ..... 139/11
5,241,994 A * 9/1993 Gunther et al. ..... 139/449
5,247,968 A * 9/1993 Hubner et al. ..... 139/438
5,522,434 A * 6/1996 Lindblom ..... 139/1 E
6,006,795 A * 12/1999 Corain et al. ..... 139/453
6,026,864 A * 2/2000 Corain et al. ..... 139/449
6,397,898 B2 * 6/2002 Lindblom ..... 139/194
6,532,996 B2 * 3/2003 Tamura ..... 139/1 E

* cited by examiner

*Primary Examiner*—Robert H. Muromoto
(74) *Attorney, Agent, or Firm*—Connolly Bove Lodge & Hutz LLP

(57) ABSTRACT

A power weaving loom includes weft thread insertion and collecting bands (6, 7). Drive units drive the bands and cause leading parts of the bands to move towards and away from one another between sides of the weaving machine and an approximately half-width position (13) of the machine. The bands include grippers (6*b*, 7*b*), which allow the weft thread to be drawn from a first side of the machine to the approximately half-width position and then to a second side of the machine. The drive units include servomotors which are coordinated to act upon the bands via motion-transmitting members with a torque that allows inward and return motions of the bands during brief shedding times, thus providing high machine picking speeds even in machines of great width.

20 Claims, 4 Drawing Sheets

Figures 1, 1A, 1B, 1C, 1D:
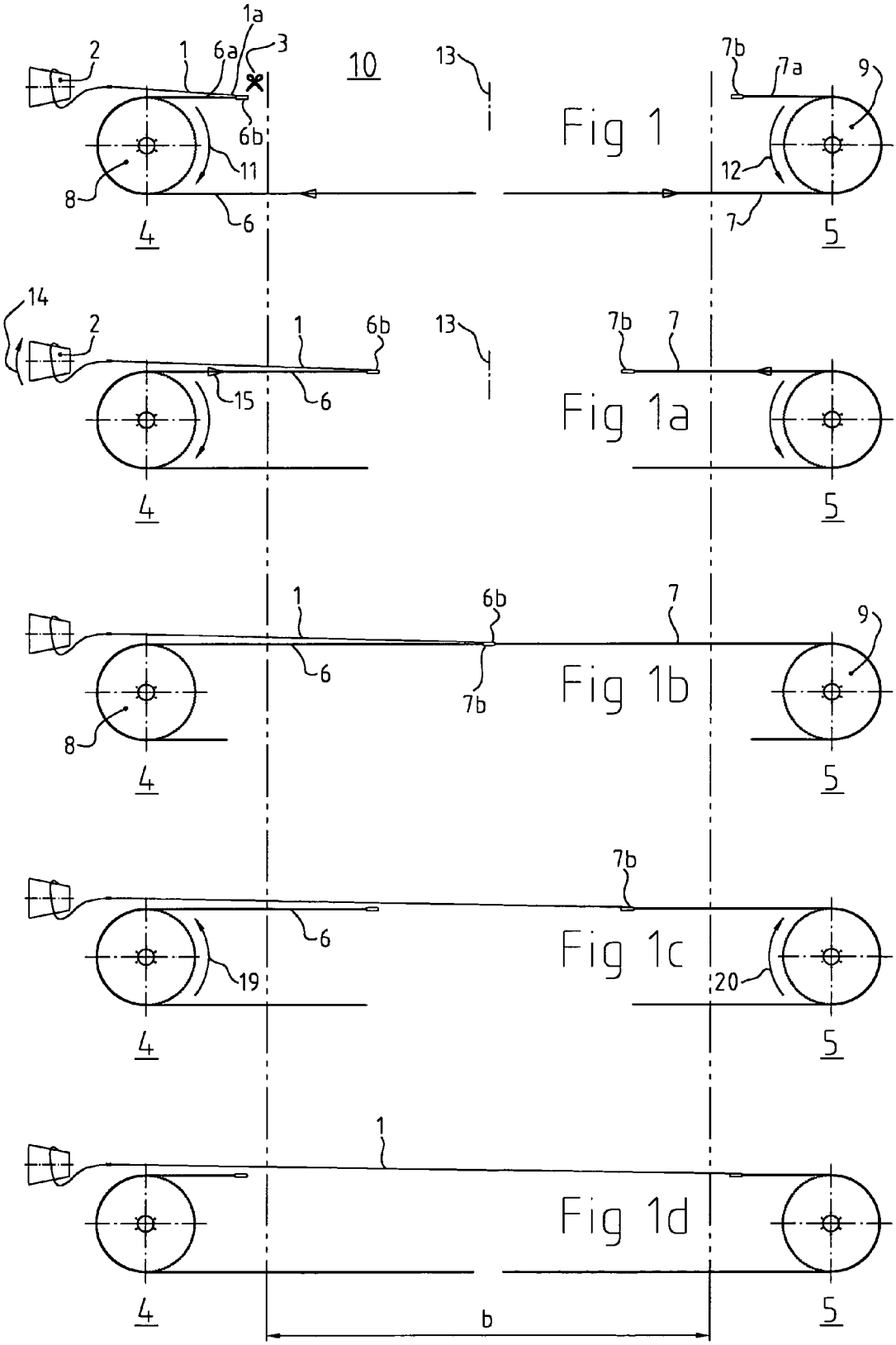

1a
2
1
6a
3
10
13
7b
7a
9
6b
11
12
8
6
7
4
5

14
2
1
6b
13
7b
7
15
6

4
5
1
6b
7
9
6
7b 8
4
5
7b
6

19
20
4
5
1

4
b
5

0°
180°
360° (0°)
54
59
58
57
56
55

33
34
35
36
37
38
39
42
43
44
60
22
41
40
51
52
48
47
49
53
46
45
50

DEVICE FOR A WEAVING MACHINE

The present invention relates to a device in a weaving machine or forming fabric machine comprising weft thread insertion and collecting bands powered by drive units to permit a high picking speed with a resulting short shedding time despite the machine having an exceptional width, for example a width of 8 to 14 meters. The drive units comprise servomotor arrangements which by way of motion-transmitting members (for example, gears) at each shedding cause leading parts of the bands to move towards and away from one another between the sides of the machine and an approximately half-width position on the machine. The leading part of the insertion band is at the same time provided with a first gripper, by means of which the weft thread can be drawn from the first side of the machine to the said half-width position on the machine. The leading part of the collecting band is provided with a second gripper, which is designed to take over the gripping of the weft thread from the first gripper and draw the weft thread on from the said middle position to the second side of the machine.

Machines having such insertion and collecting bands with grippers, so-called Rapier equipment, have long been known. It has therefore been proposed to use the equipment on machines with relatively short widths of 3 to 4 meters, for example, in which the working principle of the Rapier equipment has allowed acceptable picking speeds. It is possible to cite examples of such machines with Rapier equipment on sale on the open market.

There is now a desire to be able to utilize the Rapier equipment for power weaving looms of substantially greater width, for example widths of the said magnitude up to approximately 14 meters. In machines of such larger widths the equipment hitherto proposed would result in a picking speed substantially less than that desired. If used over widths of 14 meters, for example, present arrangements would mean picking speeds as low as 60 picks per minute, which is unacceptable.

The object of the present invention is to address this problem, among others, and to propose an arrangement that can manage picking speeds in the order of 100 picks per minute over a machine width of 14 meters, for example. The servomotors used may have a relatively low moment of inertia and there is therefore no need to propose the use of a single servomotor which can provide the requisite torque. Such a servomotor, which is currently unavailable, would have a high internal moment of inertia, which could make solution of the overall problem more difficult.

A device according to the invention is essentially characterized in that the servo arrangement in each drive unit for each band comprises two or more servomotors, which are designed in a co-ordinated function to act upon the band via the motion-transmitting member (the gear wheel) with a torque which permits inward and return movements of each band during the aforementioned brief shedding time.

In developments of the idea of the invention, the servomotor arrangement with the two servomotors is capable of delivering torque substantially in excess of 45 Nm but still has the requisite acceleration speed. Each arrangement must preferably be capable of producing torque of 50 to 90 Nm, preferably in the range of 75 to 90 Nm and acceleration speeds compatible with brief shedding times. The servomotors in each arrangement preferably contribute equal torques and each servomotor arrangement is designed to permit machine picking speeds of between 75 and 100 picks per minute. In one embodiment each arrangement can permit picking speeds in the order of 100 picks per minute even on a machine of a width in the upper width range, for example a machine width in the order of 14 meters. Each servomotor arrangement is designed to provide insertion and drawing speeds which together with the time for the machine beating-up function fall within a time range of 0.5 to 0.7 seconds, preferably approximately 0.6 seconds. The servomotors in each arrangement are jointly controlled by means of electrical signals from the machine control unit. The servomotors together act on the intakes and outlets of each band by way of a motion-transmitting member in the form of a gear, which may have a diameter D of 200 to 400 mm, for example approximately 360 mm. The servomotor arrangements for the two bands are essentially similar, preferably completely identical.

The proposals outlined above allow each servomotor arrangement to be created using commercially available servomotors having a relatively low moment of inertia, which provide the necessary rates of acceleration and speeds. The co-ordination function for the servomotors in each arrangement can be advantageously designed so as to allow the servomotors to reliably operate together with co-ordinated control from the control unit of the textile machine.

Figure 2:
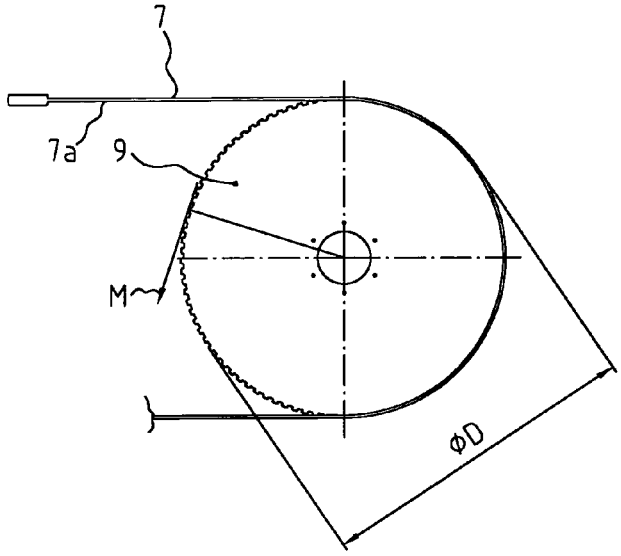
Figure 3:
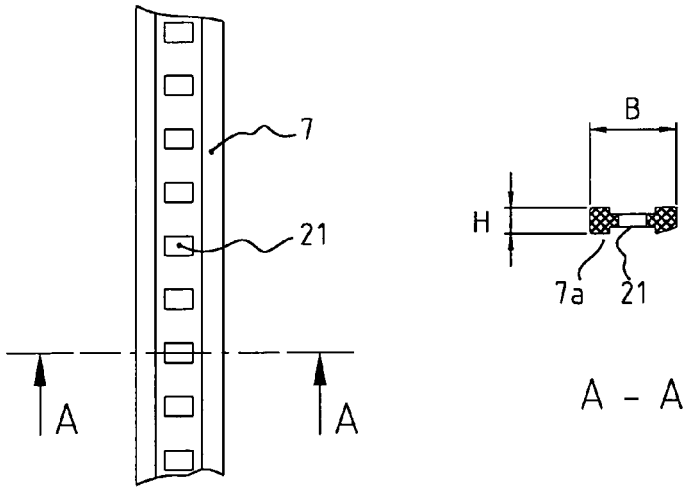
Figure 4:
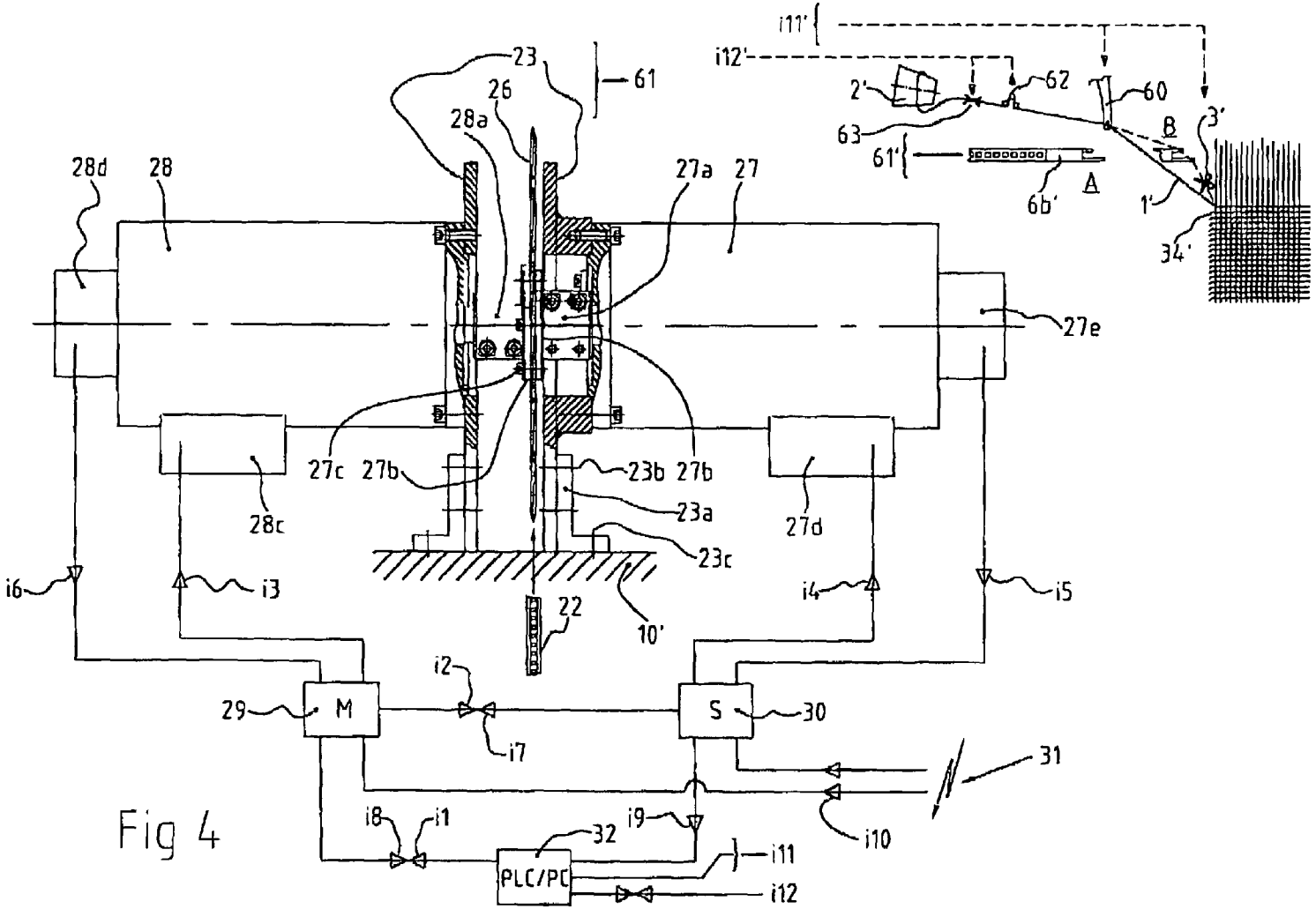
Figures 5, 5A:
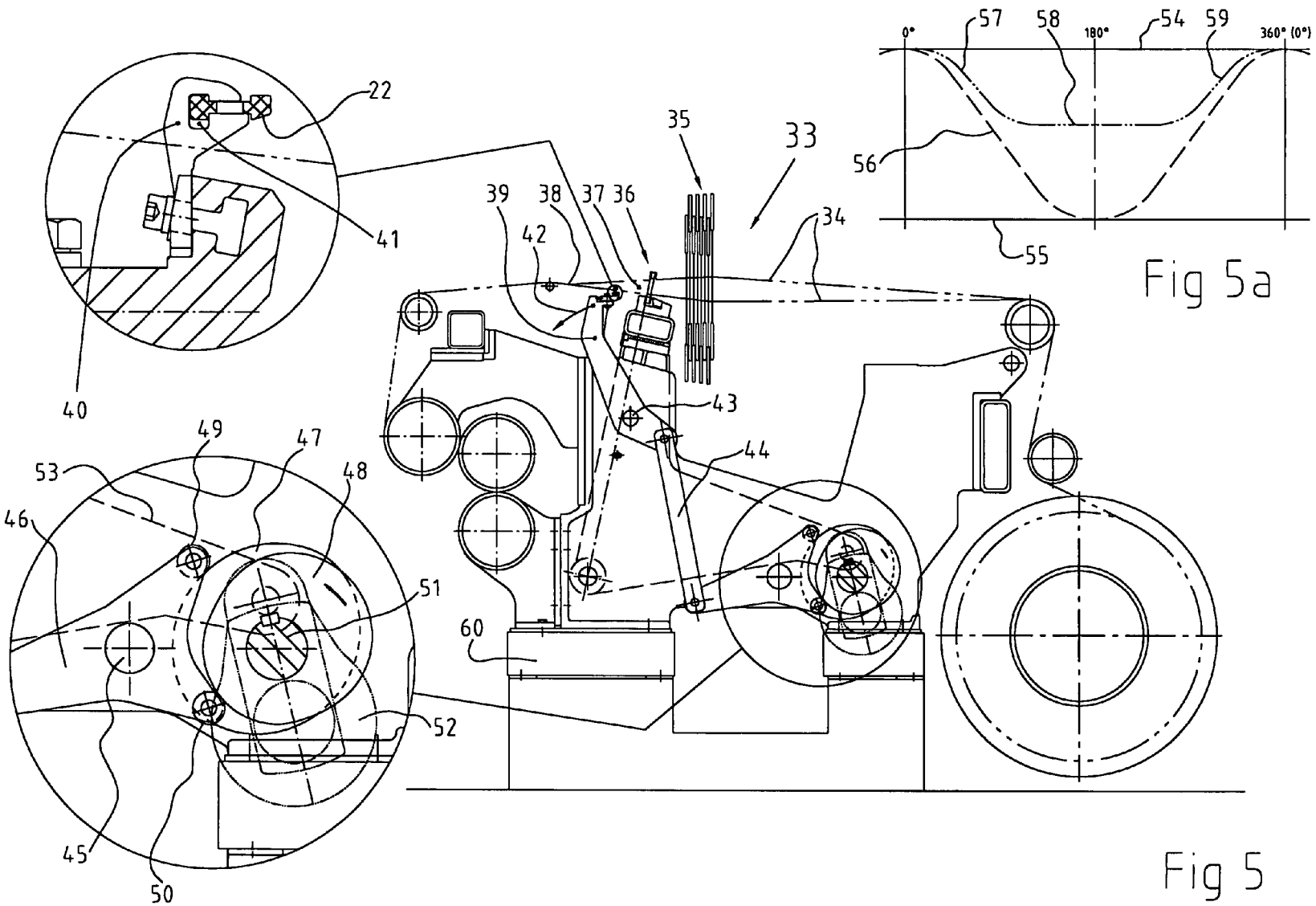

A currently proposed embodiment of a device having the typical characteristics of the invention will be described below with reference to drawings attached, in which FIG. 1–1*d* show a schematic representation of the different working stages of the insertion and collecting bands in a textile machine (not shown), FIG. 2 shows a longitudinal section though the drive for one of the said bands by means of a motion-transmitting member in the form of a gear, FIG. 3 shows a horizontal view and a cross-section through the design of each band, FIG. 4 shows a schematic side view of a drive unit with gear driven by two servomotors that are operated together and electrically controlled by or from the control unit of the textile machine, and FIG. 5–5*a* shows a schematic side view of the shedding function in an actual textile machine and a diagram, respectively.

In FIG. 1 a weft thread is basically denoted by 1. The weft thread can be fed from a magazine 2 and cut by a cutting function 3. One side of the machine, here called the first side, is denoted by 4 and the second side of the machine is denoted by 5. The weft thread 1 is to be inserted from the first side 4 and drawn over to the second side 5, said cutting function 3 being activated at the start of drawing when the thread is firmly held at the selvedge. The weft thread is drawn in and drawn onwards by means of an insertion band 6 and a collecting band 7. The bands which are stiff in nature can at the same time be bent over a motion-transmitting member 8, 9 on either side of the machine. In one example of an embodiment the bands may be made of carbon fibre-reinforced plastic. The upper parts 6*a*, 7*a* of the band, as described below, can be drawn in and out during the shedding of the textile machine in question. On their leading parts the bands 6 and 7 are provided with grippers 6*b* and 7*b*, which can grip around the relevant thread, for example the thread part 1*a*, causing it to be drawn in from side 4 of the machine and onwards to side 5 of the machine. At the rotation of the motion-transmitting members 8 and 9 in the directions of rotation of the arrows 11 and 12, the bands are brought inwards into the machine symbolized by 10 towards a middle position 13. In the position shown in FIG. 1 the gripper 6*b* has interacted with the thread part 1*a* and begun to draw it in towards the middle position 13. The width of the machine has been indicated by b and in this example of an embodiment is up to 14 meters. The invention also works for greater widths, for example widths of up to 25–50 meters, that is to say a width range may be 8 to 30 meters.

FIG. 1*a* shows the stage in which the drawing-in process is approximately half completed. Under the rotation of the magazine, the weft thread 1 is drawn via the end of the magazine 2 in the direction of the arrow 14. The direction of the insertion band is denoted by 15. Simultaneously with this function the collecting band 7 is fed in towards the said position 13, where grippers 6*b* and 7*b* on the bands must act in concert. During this operating stage the motion-transmitting members have been accelerated, giving them the necessary speed.

FIG. 1*b* shows the stage in which the leading ends of the bands 6 and 7 or the grippers 6*b* and 7*b* on the bands can interact so that the weft thread 1, for drawing on towards the second side 5 of the textile machine, can be transferred to the gripper 7*b* of the collecting band. At this stage the motion-transmitting members 8 and 9 have been braked.

FIG. 1*c* shows the stage in which the process of drawing on to the second side 5 has reached approximately half way. The insertion band 6 is brought back towards the first side 4 of the machine and the leading parts of the collecting band are brought back to the second side 5 of the machine carrying the weft thread by means of the gripper 7*b*. The reverse drive directions 19 and 20 have therefore been imparted to the motion-transmitting members 8, 9 respectively.

FIG. 1*d* shows the stage at which the weft thread 1 has been entirely drawn through the machine shed in question to the second side 5. Once fully drawn through the weft thread can now be beaten up or woven in. The function can then be repeated with the succeeding weft thread, etc.

FIG. 2 shows a more detailed design of the motion-transmitting member 9 and how it is driven by the collecting band 7. Corresponding arrangements are provided for the insertion band 6 and the motion-transmitting member 8 and will therefore not be described in further detail here. A torque which the member 9 must exert on the band 7 is indicated by M. The diameter D of the motion-transmitting member may be 360 mm, for example.

According to FIG. 3 the band 7 must have a certain stiffness and at the same time a certain pliability around the motion-transmitting member. The upper parts of the band are threaded in and out of the shed as outlined above whilst the lower parts of the band are drawn down under the shed-regulating parts to lower parts of the machine, such as floor parts in which a tube or guide ducts is/are arranged for guiding and controlling the band. The band may have a width B of approximately 10 to 15 mm and a height H of approximately 3 to 5 mm. On its underside 7*a* the band is provided with members 21, by means of which or via which the motion-transmitting member interacts with the band to drive the latter in and out of the shed. The said members 21 preferably consist of recesses.

FIG. 4 shows a drive unit 23 for the band 22 in question (cf. the bands 6 and 7 above). The drive unit comprises bearing parts 24 and 25 for the motion-transmitting member 26 (cf. 8, 9 above). Forming part of the arrangement are two servomotors 27, 28. In principle it is possible to use more than two servomotors, but according to FIG. 4 two are preferably used. The servomotors are designed with drive shafts 27*a*, 28*a* which via bearings 29, 30 mesh with the gear 26 for joint driving of the latter. Connected to the shafts are clutch disks 27*b* and 28*b*, which are rigidly connected to one another by fasteners, for example bolts 27*c*. Alternatively the gear may have central recesses with a cross-section that permits the said transmission of motion, for example a triangular cross-section, a square cross-section, etc. The side parts 23 can be mechanically anchored to the machine frame 10' by angle-irons 23*a* and anchoring members, such as bolts 23*b*, 23*c*. The servomotors 27 and 28 are anchored to the side parts by means of bolts or the like. The motor shafts extend through recesses in the side parts 23, which between them form a space for the motion-transmitting member or the gear 26, in which space the band 22 can run. The arrangement is identical on both sides of the power weaving loom (see 4 and 5 and 10 in FIG. 1).

The servo system used may be electrical or hydraulic, and in the example of an embodiment according to FIG. 4 an electrical servo system is proposed having a master control unit 29 and a slave unit 30. An electrical power feed source is symbolized by 31 and the control unit (processor unit) for the textile machine is indicated by 32. The control unit 32 controls the master unit 29 by means of signals i1. The master unit actuates the slave unit 30 by means of signals i2 and electrical circuits 28*c* of the servomotor 28 by means of voltage power signals i3. The slave unit actuates electrical circuits 27*d* of the servomotor 27 by means of signals i4. Resolvers 27*e* and 28*d* of the servomotors send feedback signals i5 and i6 to the master and slave units. The slave unit returns the signal i7 to the master unit. The master and slave units return the signals i8 and i9 to the control unit 32. The power supply is indicated by i10. Since the servo system as such may operate in a manner known in the art its working will not be described in more detail here, it being merely noted that the signals i1 are command signals to the master unit and the signals i8 are status or feedback signals to the unit 32. The signals i2 and i7 are synchronization signals between the master and slave units. The signals i9 are status or feedback signals from the slave unit to the control unit 32. The signals i3 and i4 represent electrical power signals to the servomotors 27, 28.

FIG. 5 shows a schematic representation of parts of a machine which utilizes the functions described above. The machine may consist of the FormStar® machine sold on the open market by TEXO, which is used for manufacturing wire gauze. The machine is symbolized by 33 and its schematically indicated warp threads have the designation 34. The machine functions in a known manner by means of a heald frame arrangement 35 and a beating-up unit or slay 36. The heald frame arrangement serves to form sheddings 37 in which the weft threads are inserted as described above. As each weft thread is drawn in, the beating-up unit 36 is actuated and presses or beat up the weft thread against the fell or the fabric edge (beat up edge) 38. The Rapier function for drawing in the weft thread and switching the draw functions of the grippers consists of a known guide arrangement in which each band 6, 7 (see FIG. 1) can be controlled. The arrangement which is controlled by a link 39 in the textile machine has a number of guides 40 arranged in succession over the width of the machine, which are each provided with a through-opening extending at right angles to the plane of projection of the figure, in which the band 22 can fully or partially extend. The thus partially enclosed band 22 runs perpendicular to the plane of projection and enters and leaves the guides in the movements described above. The guides are arranged relatively close together at an interval of 15–25 mm from one another, for example. At the shedding stage the guides with openings 41 extend into the shed between the warp threads. When the shed closes the guides are lowered out of the shed, that is to say turned downwards so as not to impede the beating-up function. The lowering direction is indicated by 42. The insertions and lowerings are controlled by the link 39. The raising and lowering of the guide or hooks 40 are controlled by the link 39 which is journalled with or around the axis 43 and which tilting movements are controlled by means of a further link arm 44 which can be actuated by means a unit 46 which is tiltable with or around an axis 45. The unit 46 can be actuated by means of a driving curve 47 and a holding-on curve 48 via cam roll 49 which co-operates with the driving curve and cam roll 50 which interacts with the holding-on curve. Said curves are driven by the crankshaft 51 of the machine with a speed which can be 60–120 r/min. The arrangement also comprises a connecting rod 52, by means of which box leg(-s) 53 is or are driven from the crankshaft 51. Such an arrangement is known per se and, therefore, it will not be described in detail. The cam roll of the holding-on curve guarantees that the cam roll of the driving curve is fit-up against the driving curve in spite of the great speed of the crankshaft. The cam operation is aparted and the driving curve is positioned on the right side and the holding-on curve is positioned on the left side. The guide or hock path is adapted with a link system (39, 44, 46) which is driven by the driving curve (47) which above the folding in and out movements also causes a stationary periods for the hooks/path in order to let the rapier bands or lines (6, 7) be able to move in to and out from the guides/hooks. The slay hits the weaving edge in a position 4° past a vertical line. In the backwards inclining angle of 8.5° of the slay, the guide or hock path is stopped in the shot position of the machine when the slay is still moving backwards. When the slay after that is moving forwardly in its movements to the weaving edge, the link arrangement starts its folding out function of the guide or hock path and each guide or hook of the parts are folded out via the warp wires. The total movement of the box leg is about 16.14°, which means that the angle of the standstill or stationary position of the hook path is about 3.64°, which is valid both for forwards and backwards movements, e.g. totally about 7.280°. This corresponds to about 152.62° for the weaving radius of the connecting rod. When the hock path is stationary the weaving thread or weft is drawn in over the weaving width, see above. The small movements of the guides or hooks mean reduced or essentially reduced wear on the warp wires.

FIG. 5*a* shows the position of the slay in relation to the crankshaft positions. The forward and backwards positions are shown with 54 and 55, respectively, and the movement of the crankshaft is shown between 0–360°. The movement curve of the slay (sinusoidal) is shown with 56 and the hook path movement curve with 57, 58 and 59. The curve parts 57 and 59 represent the folding in and out phases and 58 the stationary phase. Thus, the slay is never standstill during respective turn of the crankshaft, while the hook path has a part (=the horizontal part in FIG. 5*a*) of the crankshaft turn (152.63° ) with standstill when the weft is drawn over the weaving width. The operation with the crankshaft of the box legs presents a soft sinusoidal curve in contrary to other driving system fundamentals. The hocks or guides which guide the rapier bands or lines in their movements are passing through the warp wires in the lower shed only short distances (short movement, for example 40–60 mm, preferably about 50 mm.) which reduces said wear of the warp wires. The driving operation and the arrangement of the rapier path is arranged stationary in the outer framework 60 of the machine, e.g. the rapier band are not rocking together with the box legs 53.

Hocks 40 are chamfered in order not to cause wears on the warps. In FIG. 4 left gripper has taken a position A from which it is ready to catch a weft thread selected by a selector device 60 which can selects threads having different diameters, for example 0.11, 0.2 and 0.3 mm. Said device has different eyes for the threads and only one is shown in FIG. 4. The gripper can catch the selected thread 1' and actuate the thread to the scissors 3'. When the scissors is cutting the thread the catcher 6*b'* is standstill or nearly standstill, which is important for not causing deviations. The time of standstill 13 is 50–100 ms. The gripper takes its standstill position in B. The gripper can be actuated to different positions B by the control unit 32. When the gripper has catched thread 1' it starts to move through the warps threads 34' when the shed is opened and the hooks 40 take their positions in the shed. The standstill arrangement makes it possible to cut the thread 1' in the exact moment. In the known arrangement this has been a problem, due to the fact that deviations in speed of 0.5 ms can minimize the quality of the weft. Said problems have been caused also by the use of different diameters of the threads. The gripper catches the threads by means of a known spring arrangement, into which the threads can be pressed more or less. For example, there is a danger that the gripper 7*b* could tear off the thread having a small diameter if this one has been pressed in deeply in the spring arrangement, which comprises a flat spring or feather attached in its own end and is clamping is respective weft thread with its free end or not clamped part. The arrangement allows that no deviations occur between the positions of the gripper and the scissors or cutter. The weaving machine is more simple to adjust because the different part moments can be effected between stop intervals. The arrangement saves time during the weaving procedure and the bands can be driven faster in their movements through the shed. The woven product will be approved, as well. The control unit 32 comprises a personal computer PC and programmable logic control PLC. The unit 32 the selector device 60 and the scissors 3', which is symbolized with i11 and i11'. The magazine or feed thread device 2' and the spoole are separately controlled and a not disclosed motor on the magazine is adapted to fill the magazine with thread. The connection between the equipments 28, 27 and 6*b'* is symbolized with 61, 61". It is also proposed to arrange tension determing members 62, 63 between the magazine 2' and the members of the selector device 60. Member 62 is an electronic device which senses or measures the tension of the weft thread. It causes a signal (=part of i12', i12, see the left directed arrow) to said PC of the control unit 32. Said PC return a control signal (=part of i12', i12, see the right directed arrow) to member 63 which represents an electronic thread braking member which adjusts the weft thread tension(-s) to the same or in advance set value(-s) in dependence of the received signal. The tension(-s) can then be kept on the same or set value(-s) from one pick of the weaving machine to another pick. A further improved quality will then be attained for the woven material.

The invention is not limited to the embodiment demonstrated above by way of example but lends itself to modifications within the scope of the following patent claims and the idea of the invention.

The invention claimed is:

1. A device in a weaving machine comprising:

a weft thread insertion band including a first leading part having a first gripper;

a weft thread collecting band including a second leading part having a second gripper; and drive units powering said weft thread insertion band and said weft thread collecting band, said drive units comprising servomotor arrangements which, by way of motion-transmitting members at each shedding of the weaving machine, cause said leading part of said weft thread insertion band and said leading part of said weft thread collecting band to move towards and away from one another between opposing sides of the machine and said approximately half-width position so as to permit a high picking speed with a resulting short shedding time, despite the weaving machine having an exceptional width, wherein:

said weft thread insertion band is arranged to grip a weft thread via said gripper and draw said weft thread from a first one of said opposing sides to said approximately half-width position;

said weft thread collecting band is arranged to take over gripping of said weft thread from the first gripper and drawn from said approximately half-width position to a second side of the machine; and at a time following selection of said weft thread by a selection device and prior to initial insertion of said weft thread through warp threads in the machine, said first gripper is at or near a standstill position as a cutting device is actuated to cut said weft thread and said weft thread is caught by said first gripper.

2. The device of claim 1, wherein said first gripper is adapted to take one of different positions determined by a control unit when said cutting device is actuated to cut said weft thread.

3. The device of claim 1, wherein said first gripper is at or near said standstill position for a time of 50–100 ms.

4. The device of claim 2, wherein said first gripper is at or near said standstill position for a time of 50–100 ms.

5. The device of claim 1, wherein deviations in speed of said first gripper when said cutting device is actuated to cut said weft thread are below 0.5 ms.

6. The device of claim 1, wherein a personal computer operates said cutting device when said first gripper is at or near said standstill position.

7. The device of claim 2, wherein a personal computer operates said cutting device when said first gripper is at or near said standstill position.

8. The device of claim 3, wherein a personal computer operates said cutting device when said first gripper is at or near said standstill position.

9. The device of claim 1, wherein the device comprises tension determining members.

10. The device of claim 2, wherein the device comprises tension determining members.

11. The device of claim 3, wherein the device comprises tension determining members.

12. The device of claim 5, wherein the device comprises tension determining members.

13. The device of claim 6, wherein the device comprises tension determining members.

14. The device of claim 9, wherein the tension determining members are arranged to keep tension on the same or a set value from one pick of the weaving machine to another pick of the weaving machine.

15. The device of claim 1, wherein said first gripper is arranged to catch threads by a spring arrangement, into which the threads can be pressed more or less.

16. The device of claim 2, wherein said first gripper is arranged to catch threads by a spring arrangement, into which the threads can be pressed more or less.

17. The device of claim 3, wherein said first gripper is arranged to catch threads by a spring arrangement, into which the threads can be pressed more or less.

18. The device of claim 5, wherein said first gripper is arranged to catch threads by a spring arrangement, into which the threads can be pressed more or less.

19. The device of claim 6, wherein said first gripper is arranged to catch threads by a spring arrangement, into which the threads can be pressed more or less.

20. The device of claim 9, wherein said first gripper is arranged to catch threads by a spring arrangement, into which the threads can be pressed more or less.

* * * * *